US005378182A

United States Patent [19]

Liu

[11] Patent Number: 5,378,182

[45] Date of Patent: Jan. 3, 1995

[54] SELF-ALIGNED PROCESS FOR GATED FIELD EMITTERS

[75] Inventor: David Nan-Chou Liu, Fong-Yuan, Taiwan, Prov. of China

[73] Assignee: Industrial Technology Research Institute, Hsinchu,

[21] Appl. No.: 94,691

[22] Filed: Jul. 22, 1993

[51] Int. Cl.[6] ..... H01J 1/30; H01J 9/02

[52] U.S. Cl. ..... 445/24; 445/50; 427/77

[58] Field of Search ..... 445/24, 50, 51; 427/77

[56] References Cited

U.S. PATENT DOCUMENTS

| | | | |
|---|---|---|---|
| 3,789,471 | 2/1974 | Spindt et al. | 445/50 |
| 4,763,187 | 8/1988 | Biberian | 358/56 |
| 4,857,161 | 8/1989 | Borel et al. | 204/192 |
| 4,857,799 | 8/1989 | Spindt et al. | 313/495 |
| 5,151,061 | 9/1992 | Sandhu | 445/24 |
| 5,188,977 | 2/1993 | Stengl et al. | 437/89 |
| 5,209,687 | 5/1993 | Konishi | 445/24 |

FOREIGN PATENT DOCUMENTS

| | | | |
|---|---|---|---|
| 520780A1 | 12/1992 | European Pat. Off. | 445/24 |
| 5-21003 | 1/1993 | Japan | 445/51 |

*Primary Examiner*—P. Austin Bradley
*Assistant Examiner*—Jeffrey T. Knapp
*Attorney, Agent, or Firm*—George O. Saile; Stephen B. Ackerman

[57] ABSTRACT

A method of forming a self-aligned gated field emitter with substantial manufacturing advantages is described. There is provided a substrate having at its surface a conductive layer. A first dielectric layer is deposited over the substrate. A conducting layer is deposited over the dielectric layer. Lithography and etching are used to form an opening through the conducting layer and the dielectric layer down to the surface of the substrate wherein there is formed an overhang of the conducting layer over the etched dielectric layer in the opening. Material is vertically deposited through the opening and over the conducting layer until the field emitter is formed and the opening is closed by build up of the depositing material over the conducting layer. At least a portion of the build up of the depositing material over the conducting layer is oxidized down to the desired opening size to form an oxide layer of the material. The oxide layer is removed by etching to expose the desired opening, thereby completing formation of the self-aligned gated field emitter.

12 Claims, 11 Drawing Sheets

SELF-ALIGNED PROCESS FOR GATED FIELD EMITTERS

BACKGROUND OF THE INVENTION (1) Field of the Invention

The invention relates to a process for making self-aligned field emitter devices and the resulting devices which can be used for various applications including flat panel displays, electron sources for lithography and the like, memory writing devices, sensors and high speed switching device.

(2) Description of the Prior Art

U.S. Pat. No. 4,763,187 to J. P. Biberian generally discusses field emission device structures including tips emitting electrons to light a fluorescent screen, using lines and columns for addressing. The structure includes a grid, at a third voltage potential (the first two potentials being those of the cathode and anode) which is used to control electron emission intensity. Biberian says that the grid solves the problem of needing low voltage levels (to allow for fast switching) but without requiring very small spacing, on the order of a few microns, between the tips and the anode structure. A few micron spacing would cause great difficulty in manufacturing. His structure using the grid also allows for the separate control of the address and intensity functions.

Another matrix addressed flat panel display is shown in U.S. Pat. No. 4,857,799 by C. A. Spindt et al. He refers to U.S. Pat. No. 3,500,102 by Crost et al which deals with a thin display using field emission, but which did not deal with gaseous breakdown, and which would still have a problem of distortion in the display picture, due to screen deflection from pressure difference between atmospheric pressure and vacuum inside display. Solutions to this problem proposed by Spindt et al included: 1) a "support structure" to prevent the distortion, 2) spacing between the cathodes and luminescent material which is less than or equal to the mean free path of electron in the interelectrode space—this would help reduce gas breakdown, and 3) isolating the cathode conductive lines by using semiconductive material between the conductive lines, to reduce cross-talk.

The U.S. Pat. No. 4,857,161 to Borel et al shows a process for the production of an array of cathode lines and grid lines that are used to address each picture element. At each picture element there are many micro-emitters that are grown on the corresponding cathode line. The many micro-emitters provide redundancy, so that if one emitter fails, there is no degradation in the display.

There are several methods for fabricating the gated field emitters. One such process is taught by the Borel et al Patent of the previous paragraph. Another process uses a silicon oxide mask on a silicon wafer and the silicon is etched under the mask until a pointed silicon structure remains under the mask. Then the dielectric and conductor layer are deposited thereover and the "hat" removed. A third process forms the emitter tip first and then forms the dielectric and conductive layers thereover. An etchback is required to expose the emitter tip. This third method is shown for example in U.S. Pat. No. 5,186,670 to Doan et al. Other methods for fabricating gated field emitter include those shown in U.S. Pat. Nos. 5,151,061 to Sandhu and 5,188,977 to Stengl et al.

The FIGS. 1 through 4 illustrate how Borel et al fabricates their gated field emitter. Typically a silicon wafer 10 is used as the substrate. A dielectric layer 12, such as silicon oxide is formed over the wafer 10. A conducting coating 14 is formed over the dielectric layer 12. Thereafter, using lithography and etching techniques openings 15 are formed through the conducting layer 14 and dielectric layer 12 to the silicon wafer 10 to produce FIG. 1. A lift off layer 18, which could be composed of nickel, aluminum, aluminum oxide or the like is formed over the layer 14 at a low angle to prevent deposit within the hole 15 to produce FIG. 2. Molybdenum or the like is deposited under normal incidence to form cone 16 within the openings and layer 20 on the surface of the lift off layer 18 as can be seen in FIG. 3. The gated field emitter is completed as seen in FIG. 4, with the lift off of the layer 20 by selectively dissolving the layer 18.

All of the above mentioned fabrication process for gated field emitters have serious drawbacks. The Borel et al process has several serious problems including (1) the lift off of the layer 20 by means of lift off layer 18 is a big problem, (2) the gate opening reduction is very limited and therefor operation voltages are limited to a high range of the order of 80 to 100 volts, and (3) the formation of the lift off layer 18 requires a very low angle deposition to prevent any of the material from entering the openings 15. The "hat" method has many problems including (1) some of the "hats" fall off during etching causing reliability problems, (2) gate opening reduction is limited and therefor will be limited to high voltage operation in the order of 80 to 100 volts and (3) only silicon and tantalum have been reported as material candidates for emitter. The third method of Doan et al has many problems which include (1) the gate cannot be made planer and (2) the device has a high capacitance and high leakage current, since dielectric thickness cannot be thick in order to have the necessary gate opening size.

It is a principal object of the invention to provide a simple and very manufacturable method for making self-aligned gated field emitters in a planar structure, without limitation as to substrate material or emitter material, and without use of a lift off process step.

Another object is the formation of a gated field emitter device which is self-aligned to the gate and with the capability to reduce the gate opening, without limitation as to substrate material and without use of a lift off process step.

SUMMARY OF THE INVENTION

In accordance with the present invention, a method of forming a self-aligned gated field emitter with substantial manufacturing advantages is described. There is provided a substrate having at its surface a conductive layer. A first dielectric layer is deposited over the substrate. A conducting layer is deposited over the dielectric layer. Lithography and etching are used to form an opening through the conducting layer and the dielectric layer down to the surface of the substrate wherein there is formed an overhang of the conducting layer over the etched dielectric layer in the opening. Material is vertically deposited through the opening and over the conducting layer until the field emitter is formed and the opening is closed by build up of the depositing material over the conducting layer. At least a portion of the build up of the depositing material over the conducting layer is oxidized down to the desired opening size to form an oxide layer of the material. The oxide layer is removed by etching to expose the desired opening which forms the self-aligned gated field emitter.

There further is described a self-aligned gated field emitter structure. A substrate is provided which has at its surface a conductive layer. A first dielectric layer is located over the substrate. A conducting layer is located over the dielectric layer. An opening is located through the conducting layer and the dielectric layer down to the surface of the substrate wherein there is an overhang of conducting layer over the dielectric layer in the opening. A conically shaped field emitter is located in self-alignment in and to the opening and extends from the surface of the substrate. A layer composed of the identical material of the field emitter is on the surface of the conducting layer and reduces the size of the opening by having a smaller opening than the conducting layer.

DESCRIPTION OF THE PREFERRED EMBODIMENTS

Figure 1:
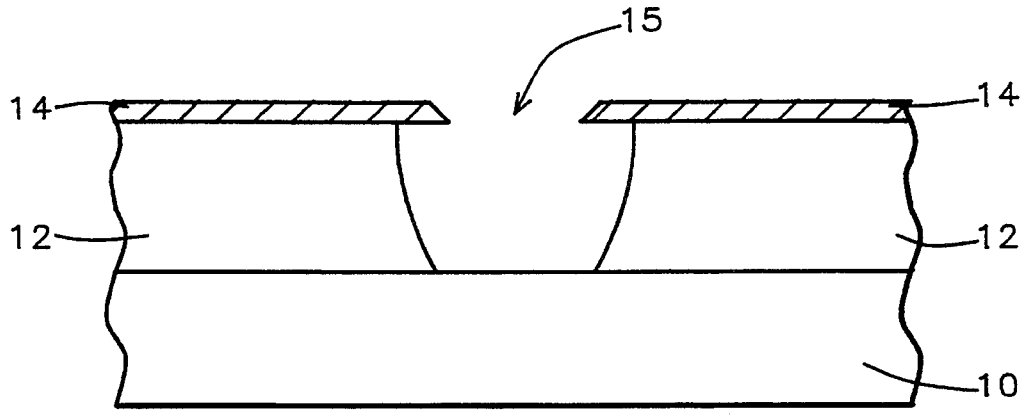
FIG. 1 Prior Art
FIGS. 1 through 4 show a greatly enlarged and schematic cross-sectional series of steps in a Prior Art process for fabricating a gated field emitter.
Figure 2:
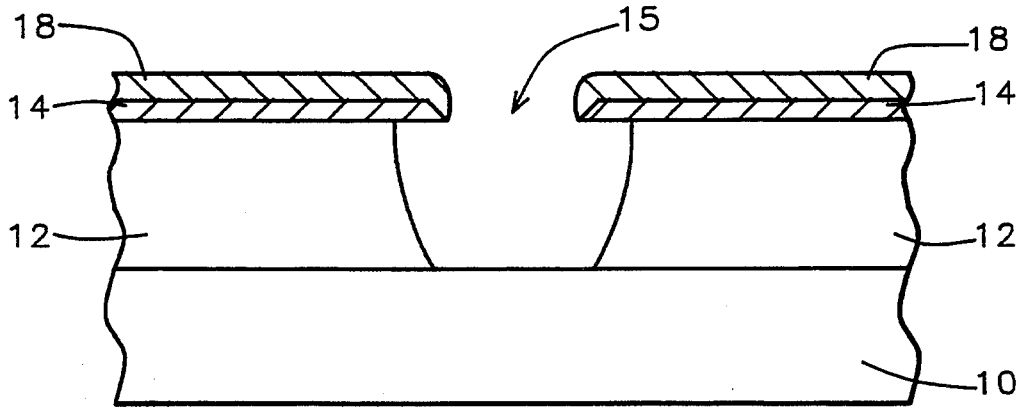
FIG. 2 Prior Art
Figure 3:
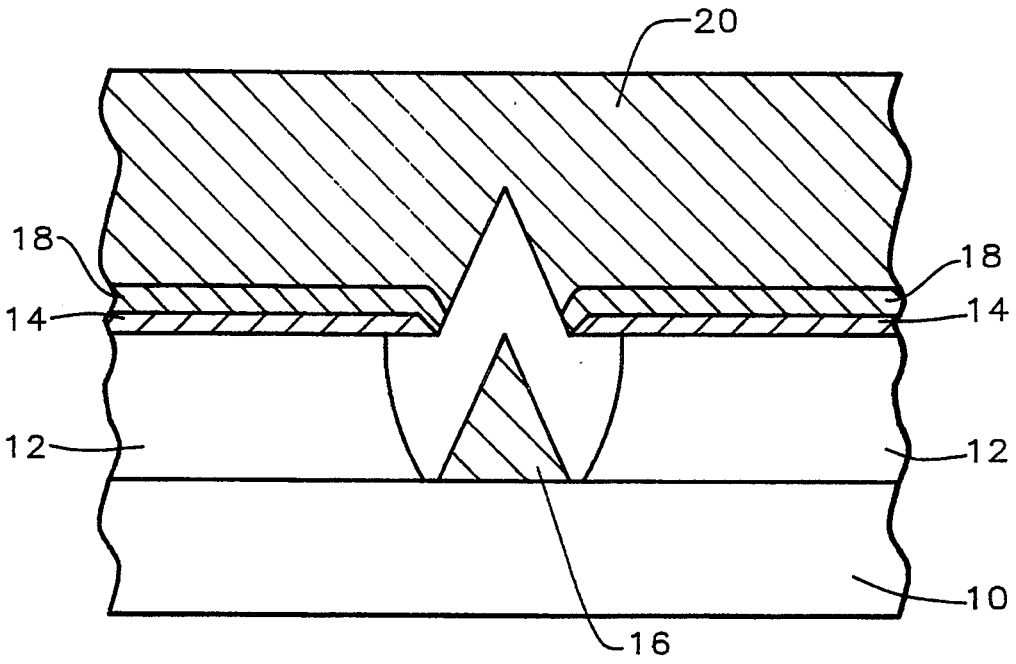
FIG. 3 Prior Art
Figure 4:
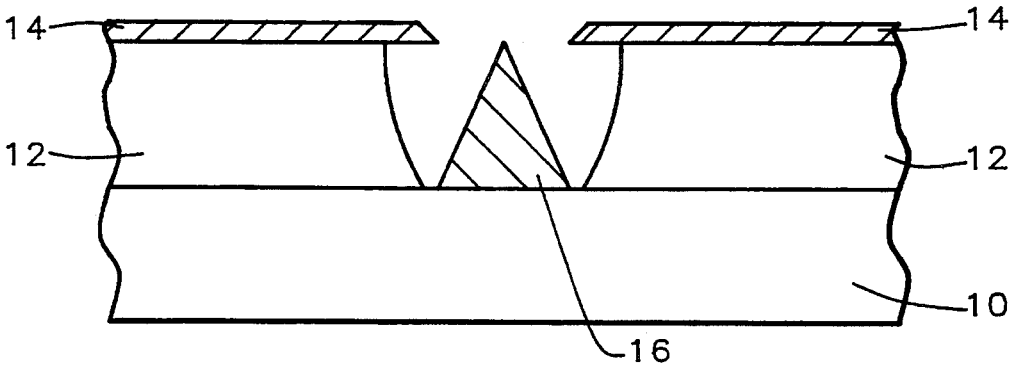
FIG. 4 Prior Art
Figure 5:
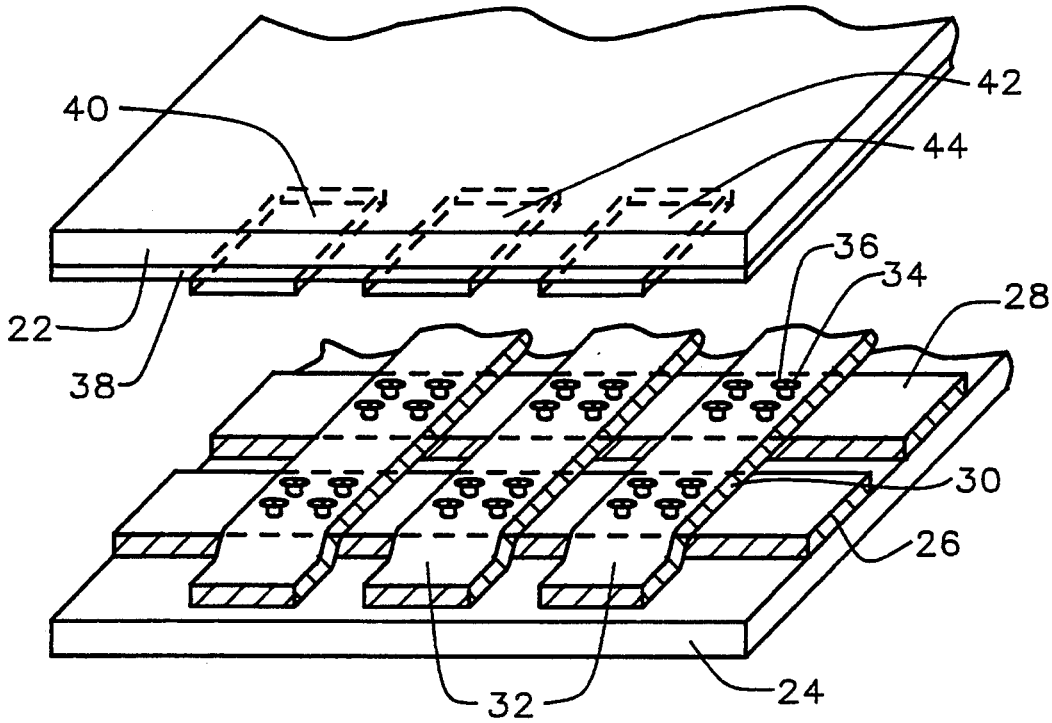
FIGS. 5 and 6 show a greatly enlarged and schematic representation of a matrix structure using the gated field emitter structure of the invention.
Figure 6:
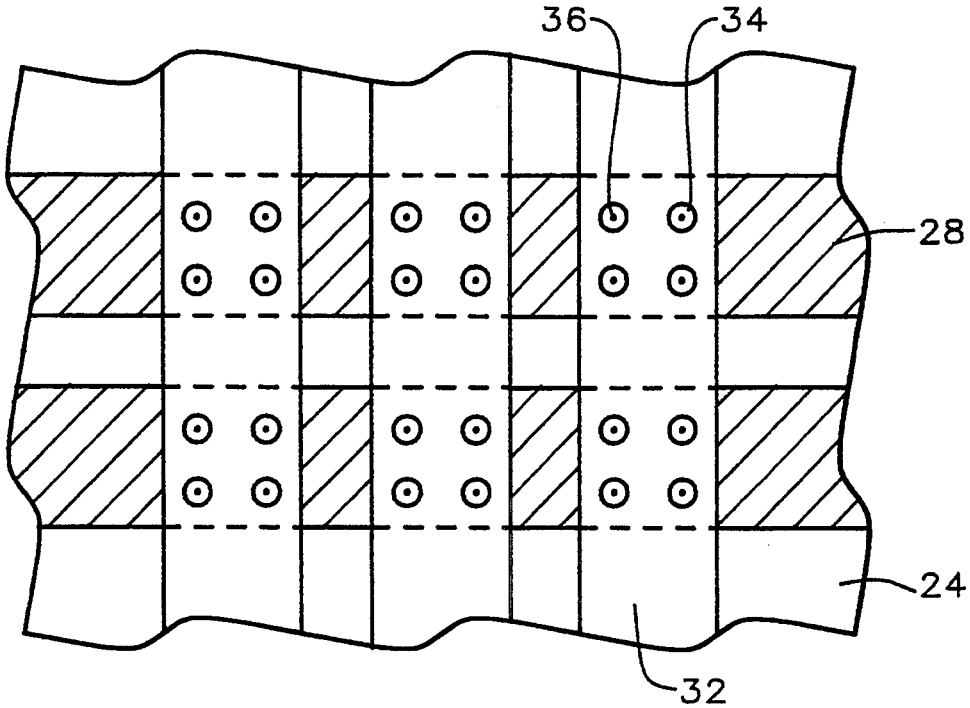

Referring now more particularly to FIGS. 5 and 6, there is shown a basic structure of a flat panel display using the present invention. Two opposing plates are sandwiched together and provide the surfaces for the various structures and materials that make up the display. Front glass plate 22 serves as the anode, and back glass (which may also be silicon) plate 24 serves as a cathode. A first series of parallel conductive and/or resistive cathode columns 28 are formed on parallel insulating strips 26. A second series of parallel conductive metallic gate lines 32 are formed on parallel insulating strips 30, above and perpendicular to the columns, and form the "lines" of the display. A plurality of holes 34 are formed in the gate lines, at the line/column intersections. Within the holes are the self-aligned gated field emitters 36 of the invention, which are in contact with cathode columns 28.

A thin dielectric layer 38 of, for instance, indium tin oxide, is used to coat front glass plate 22, and provides a base for phosphors red 40, green 42 and blue 44, which emit their respective colored light when struck by electrons emitted from the self-aligned gated field emitters 36. These electrons are emitted when an electric field is formed between the cathode and gate lines and then accelerated toward the phosphors due to the voltage bias of the anode.

FIG. 6 shows a top view of the back plate structure. Each hole 34 in gate line 32 contains one self-aligned gated field emitter 36 with its center point at the center of the hole. Gate lines 32 are perpendicular to cathode columns 28, and both are formed over back plate 24.

Referring now to FIGS. 7 through 12, the detailed way in which the self-aligned gated field emitters are formed can be more fully understood. The Figs. show only a single field emitter being formed, but it is understood by those skilled in the art that this process of the invention can be achieved simultaneously forming thousands of these emitters.

Figure 7:
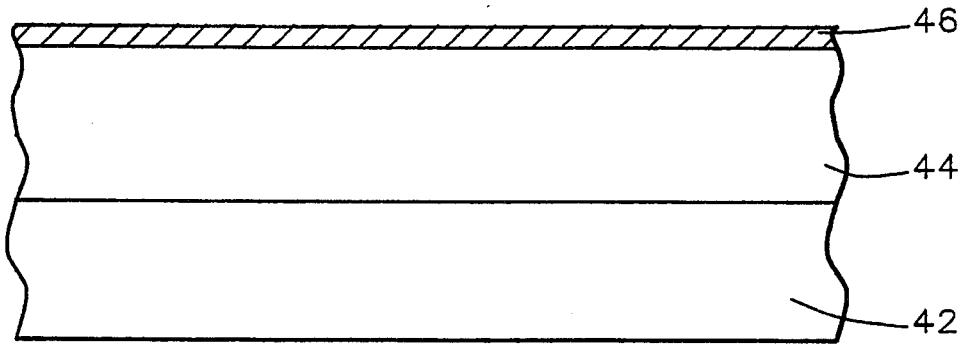
FIGS. 7 through 12 show a first process of the invention by a greatly enlarged and schematic cross-sectional series of steps for fabricating a gated field emitter of the present invention.
Figure 8:
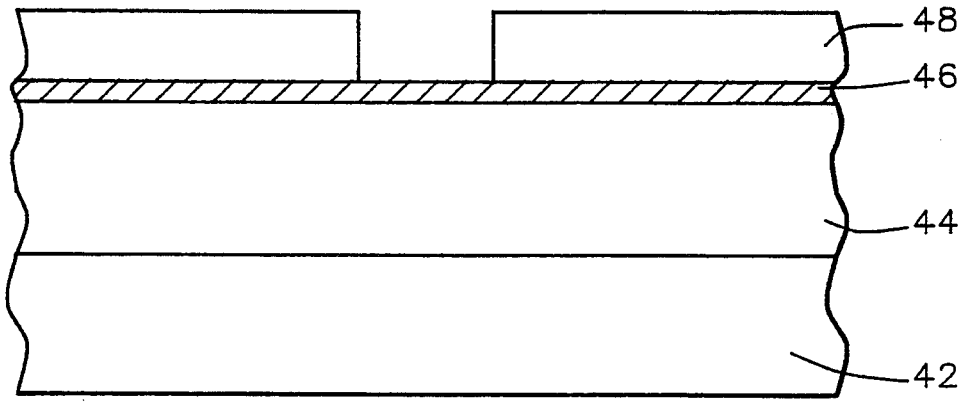

The first series of steps is shown in FIG. 7 wherein the substrate 42 which may be any crystalline, amorphous or the like material, such as silicon, amorphous silicon, polysilicon, molybdenum, tantalum, or the like, and is preferably polysilicon. The advantages of polysilicon are that it allows the formation of large display area, and its resistivity can be adjusted by doping. A dielectric layer 44, such as silicon oxide is now formed by chemical vapor deposition (CVD), sputtering or evaporation, to a thickness of between about 1 to 2 micrometers. A high dielectric strength, and thus the thickness of the dielectric layer, is particularly important in order to maintain the necessary applied voltage between the gate and the emitter, with low leakage current.

A conducting layer 46 is now deposited over the dielectric layer 44. This layer may be composed of metal, polysilicon or semiconductor. Examples of these materials are polysilicon, refractory metal silicide, molybdenum and the like. The layer is formed by CVD, sputtering, evaporation, etc. to a thickness of between about 2000 to 4000 Angstroms.

A suitable resist layer is spin coated as is well understood by those skilled in the art onto the layer 46. The resist is exposed through a mask and developed to form the desired resist mask layer 48 shown in FIG. 8 with opening therein at the planned locations of the gated field emitters to be fabricated.

Figure 9:
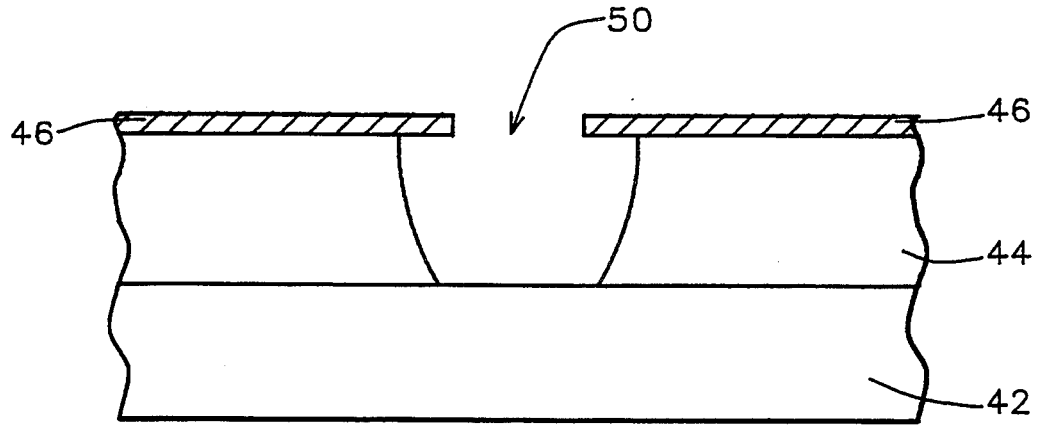

FIG. 9 shows the result of etching of the conductive layer 46 and the dielectric layer 44 using the resist mask 48 to form an opening 50. The etching process used is a wet etch or a dry etch, or a dry etch followed by wet etching, to form the critically shaped opening 50 which subsequently allows the formation of the self-aligned emitter. The dry etch followed by wet etch would be used to control the undercut under layer 46. Note that the etching process for the layer 44 was chosen to result in an overhang of layer 46. This overhang will separate the subsequent deposited emitter material during the emitter cone formation. The size of the opening 50 is limited by lithography, and also cannot be too narrow so as to prevent subsequent formation of the emitter to its full height.

The smaller the gate opening 50, the higher electric field and therefore the necessary operating voltage can be reduced. It is preferred that the openings be between about 0.7 to 1.5 micrometers at this time of the process. However, it is desired, if practical, to have the openings be less than about 0.7 micrometers. Subsequently after the emitter formation, the gate openings may be further reduced in size by a partial oxidation step.

Figure 10:
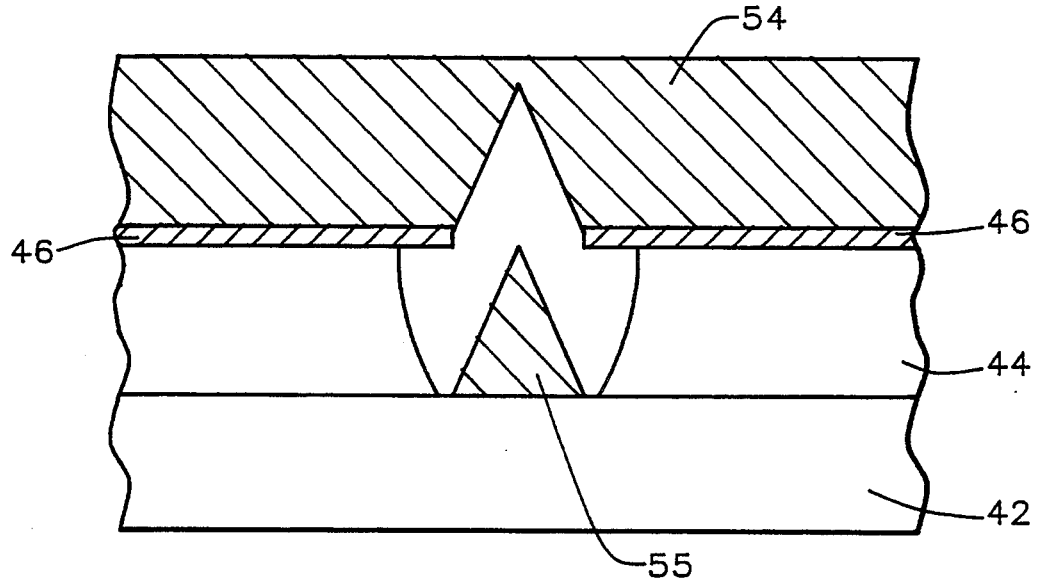
Figure 10A:
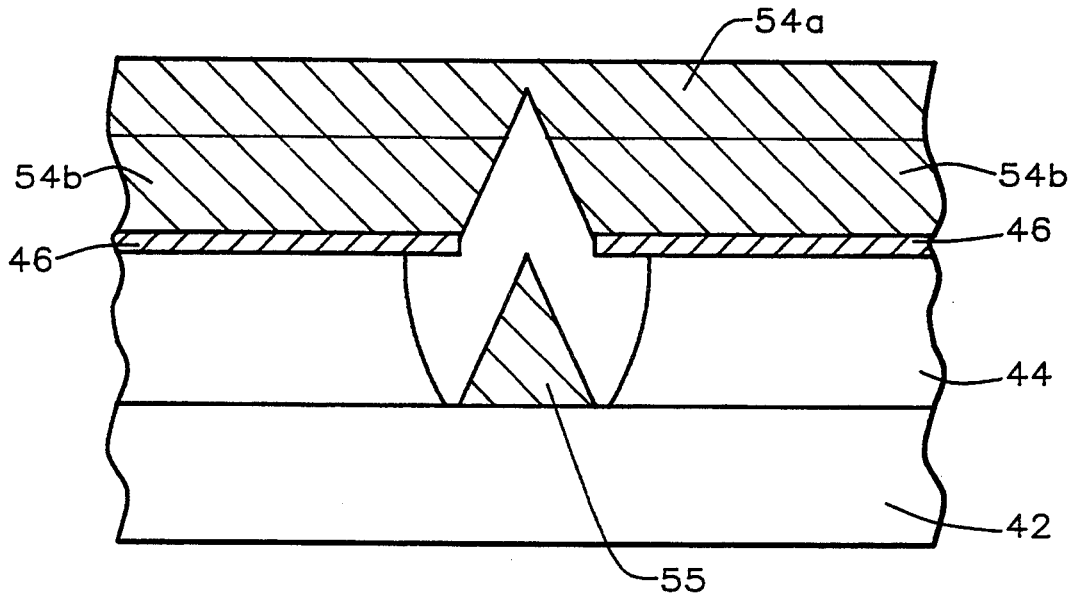

FIG. 10 shows the result of the vertical deposition by, for example, vacuum evaporation of any desired or combination of two or more of metal, polycrystalline or semiconductor material to form layer 54 and emitter 55. This material is preferred to have a high melting point to withstand more current flow, and low work function to give more emission. The only requirements of the material are that it can be evaporated and that it can be oxidized by thermal oxidation or anodic oxidation. We show the deposition of a single material in FIG. 10 to form the conical emitter 55 and the layer 54, or, alternately, the deposition of two materials, 54*a* and 54*b*, as shown in FIG. 10A, over the layer 46 and eventually to close the opening.

The following material may be oxidized by anodic oxidation, with the noted resultant oxides:

$Al \rightarrow Al_2O_3$
$Sb \rightarrow Sb_2O_4$
$Bi \rightarrow Bi_2O_3$
$Hf \rightarrow HfO_2$
$Nb \rightarrow Nb_2O_5$
$Ta \rightarrow Ta_2O_5$
$W \rightarrow WO_3$
$Y \rightarrow Y_2O_3$
$Zr \rightarrow ZrO_2$ Anodic oxidation is generated by applying a voltage between an anode and a cathode immersed in an electrolyte solution which may be aqueous, nonaqueous, or fused salt. The principle is that the transport of oxygen ions through the film, which must occur for the film to grow, is aided by the electric field which is established in the film by the applied voltage.

Figure 11:
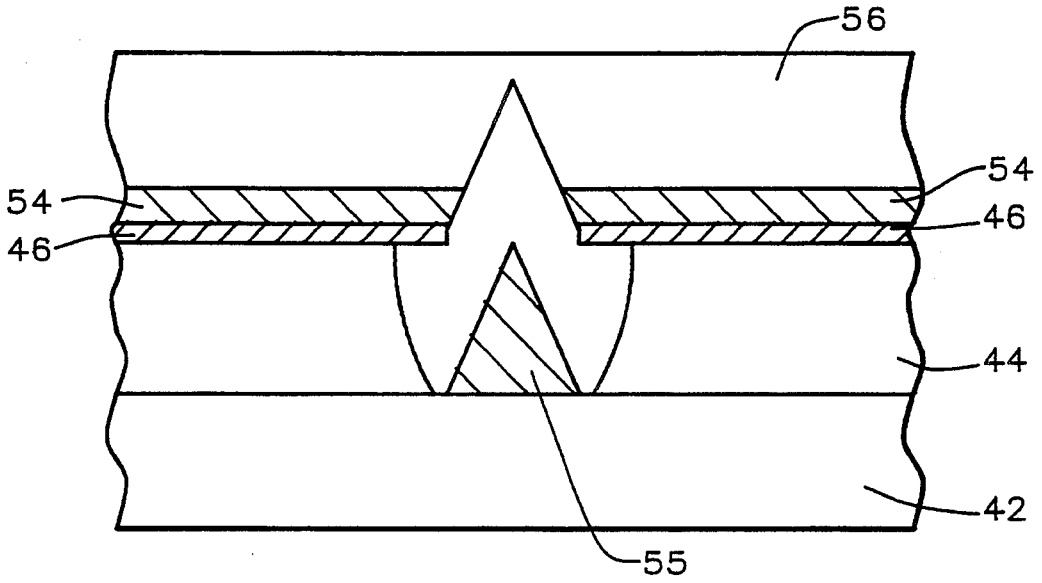
Figure 12:
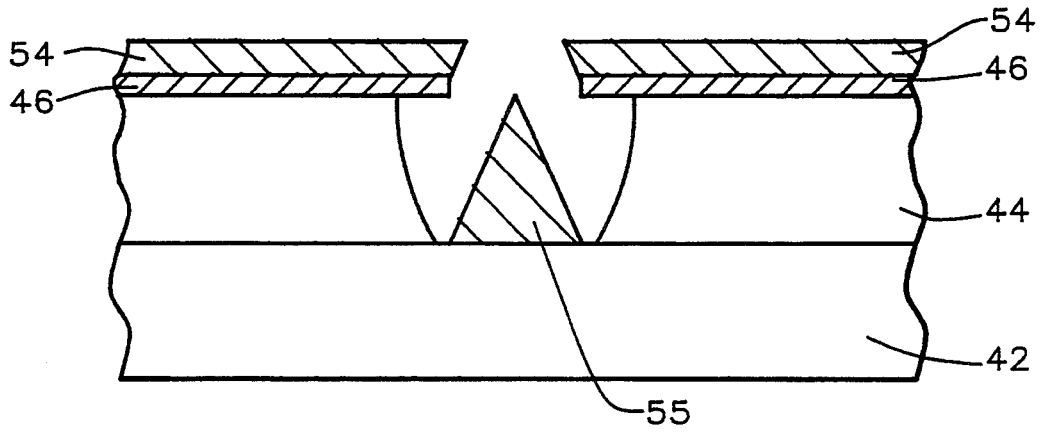

In FIG. 11, the critical oxidation step in the combination of process steps is illustrated. The material of layer 54 is oxidized either partially or completely by an oxidation step which, when using silicon, for example, as the material 54, silicon oxide layer 56 is produced. FIG. 11 illustrates the partial oxidation alternative so that we see a portion of layer 54 remaining under the oxide layer 56. The process of oxidation may be by thermal or anodic oxidation methods. The thermal oxidation is performed at a temperature of between about 900° and 980° C. and can be used where layer 54 is not suitable to anodic oxidation. Anodic oxidation can be used when low temperature processing is required.

One of the major advantages of this process is that the gated emitter is now protected from contamination until the time that the emitter needs to be used. At this time the oxide layer 56 can be removed by the suitable etching process for the oxide to form the self-aligned field emitter of FIG. 12. The layer 54 now forms a part, with layer 46, of the conductive gate electrode.

Figure 13:
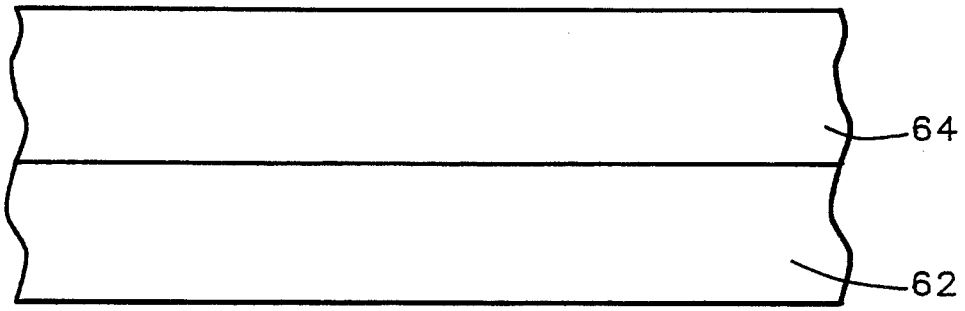
FIGS. 13 through 18 shows a second process of the invention by a greatly enlarged and schematic cross-sectional series of steps for fabricating a gated field emitter of the present invention.
Figure 14:
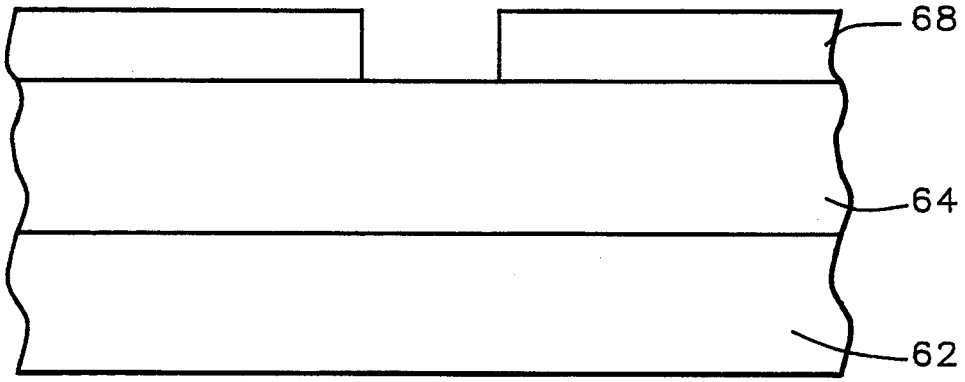

Referring now to FIGS. 13 through 18, an alternative method for forming the self-aligned gated field emitters is shown. The first series of steps is shown in FIG. 13 wherein the substrate 62 and dielectric layer 64 are shown as in the first method above. The substrate 62 may be any crystalline, amorphous or the like material, such as silicon, amorphous silicon, polysilicon, molybdenum, tantalum, or the like, and is preferably polysilicon. A dielectric layer 64, such as silicon oxide, is formed by chemical vapor deposition (CVD), sputtering or evaporation, to a thickness of between about 1 to 2 micrometers. A suitable resist layer is spin coated as is well understood by those skilled in the art onto the layer 64, as shown in FIG. 14. The resist is exposed through a mask and developed to form the desired resist mask layer 68 with openings therein at the planned locations of the gated field emitters.

Figure 15:
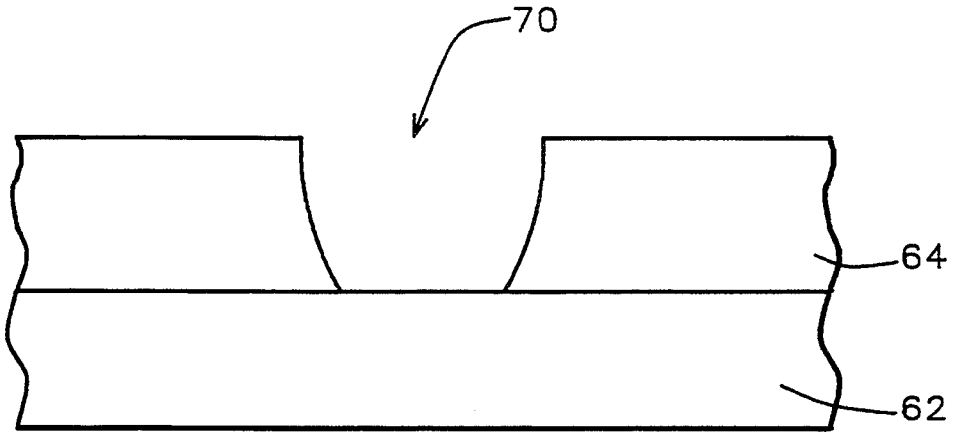

FIG. 15 shows the result of etching of the dielectric layer 64 using the resist mask 68 to form an opening 70. The etching process used is a wet etch or a dry etch, or a dry etch followed by wet etching, to form the critically shaped opening 70 which subsequently allows the formation of the self-aligned emitter.

The smaller the gate opening 70, the higher electric field and therefore the necessary operating voltage can be reduced. It is preferred that the openings be between about 0.7 to 1.5 micrometers at this time of the process. However, it is desired, if practical, to have the openings be less than about 0.7 micrometers. Subsequently after the emitter formation, the gate openings may be further reduced in size by a partial oxidation step.

Figure 16:
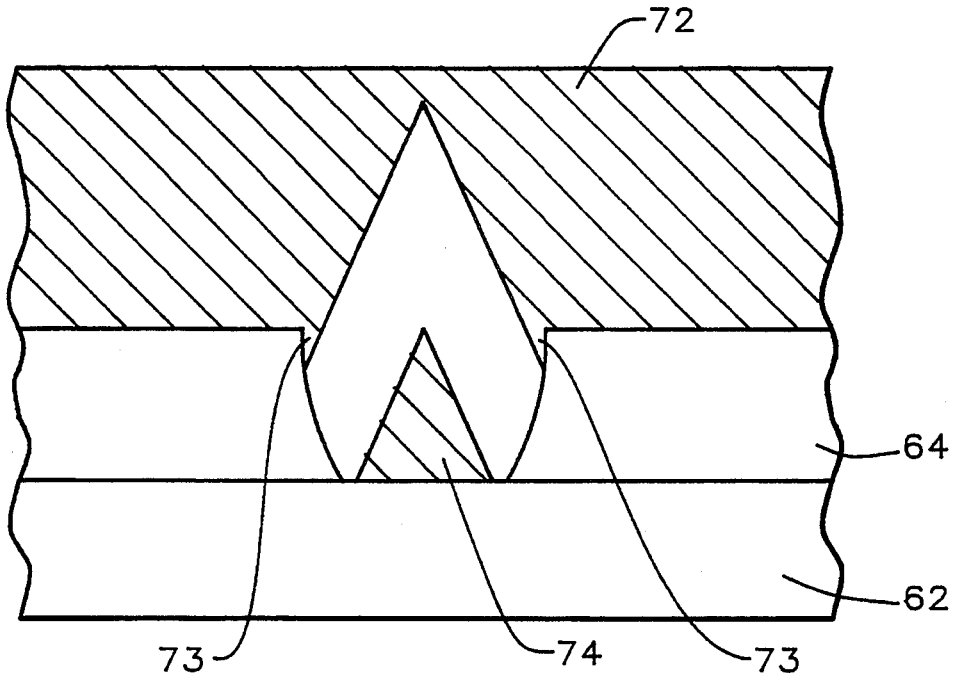

FIG. 16 shows the result of the a two-step deposition by, for example, vacuum evaporation of any desired or combination of two or more of metal, polycrystalline or semiconductor material, to form layer 72. An initial low-angle deposition to form overhang 73 is followed by a vertical deposition to form the conical emitter 74 and layer 72 over layer 44 and eventually closes the opening. The material of layer 72 and emitter 74 has the same characteristics as layer 54 in the first method.

Figure 17:
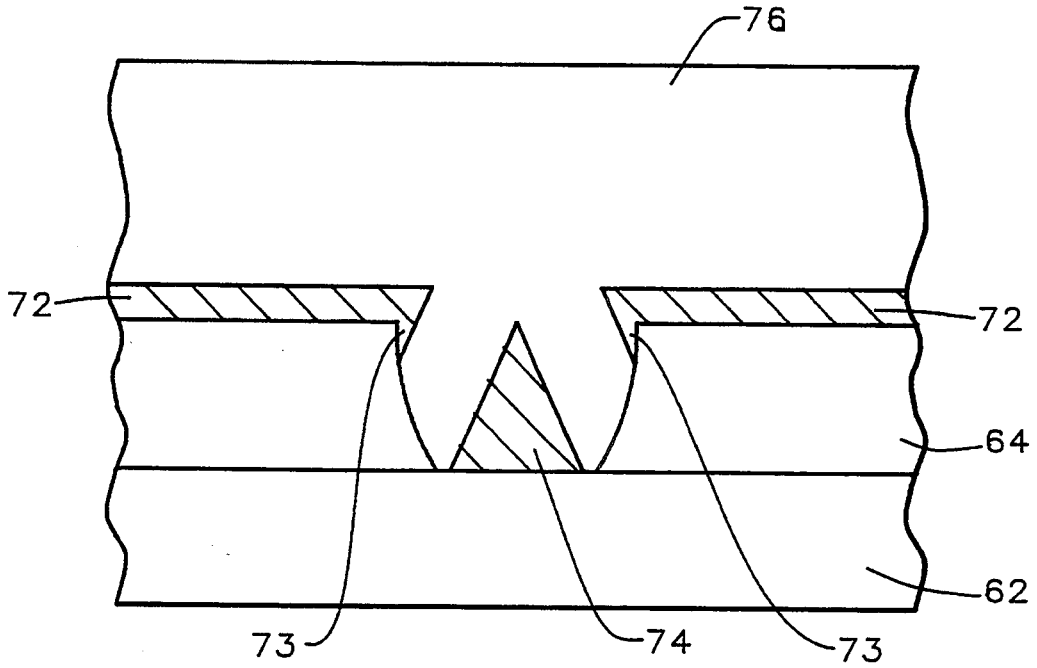
Figure 18:
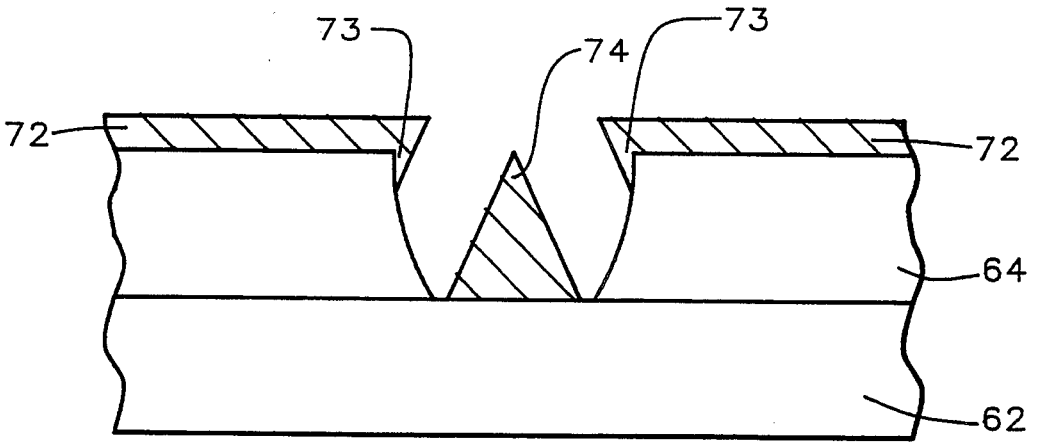

In FIG. 17, the critical oxidation step in the combination of process steps is illustrated. The material of layer 72 is oxidized either partially or completely by an oxidation step which, when using silicon, for example, as the material 72, silicon oxide layer 76 is produced. FIG. 17 illustrates the partial oxidation alternative so that we see a portion of layer 72 remaining under the oxide layer 76. The process of oxidation may be by thermal or anodic oxidation methods. The thermal oxidation is performed at a temperature of between about 900° and 980° C. and can be used where layer 72 is not suitable to anodic oxidation. Anodic oxidation can be used when low temperature processing is required.

This method also shares the advantage of the first method in protecting the gated emitter from contamination until the time that the emitter needs to be used. At this time the oxide layer 76 can be removed by the suitable etching process for the oxide to form the self-aligned field emitter of FIG. 18. The layer 72 now forms the conductive gate electrode.

Figure 19:
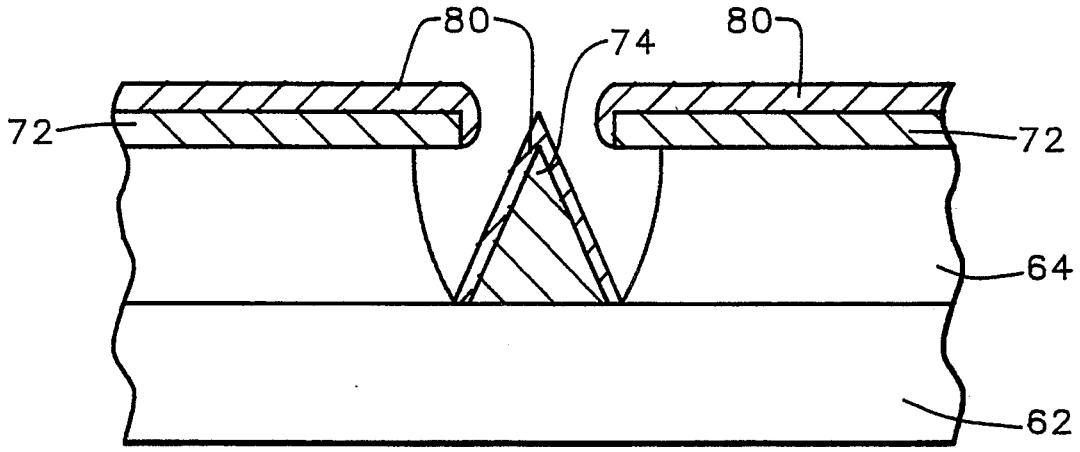
FIG. 19 shows a process of the invention by a cross-sectional representation of a step for fabricating a gated field emitter in which a coating is added to the structure to form a lower work function emitter and reduced gate opening.

Referring now to FIG. 19, a coating 80 of a same or different material (such as $BaO+SrO$, or $Cr_3Si+SiO_2$, Cs, and the like) can be applied to the gated emitter to form a lower work function emitter. Alternately, a higher melting point material could be used, such as molybdenum, tantalum, tungsten or the like. The typical thickness is less than about 200 Angstroms. This process must be a vertical evaporation to be operable, in order to avoid shorting or tip sharpness reduction. Also, sputtering cannot be used, because of its nature as a random particle deposition process. A thin layer is preferred so to provide uniformity of coverage. A further advantage of this technique is to reduce the gate opening. A smaller gate opening allows for a higher electric field and thus a reduced operating voltage.

While the invention has been particularly shown and described with reference to the preferred embodiments thereof, it will be understood by those skilled in the art that various changes in form and details may be made without departing from the spirit and scope of the invention.

What is claimed is:

1. The method of forming a self-aligned gated field emitter comprising:

providing a substrate having at its surface a conductive or resistive layer;

depositing a first dielectric layer over said substrate;

depositing a conducting layer over the said dielectric layer;

performing lithography and etching to form an opening through said conducting layer and said dielectric layer down to the surface of said substrate wherein there is formed an overhang of said conducting layer over the etched said dielectric layer in said opening;

vertically depositing material through said opening and over said conducting layer until said field emitter is formed and said opening is closed by build up of said depositing material over said conducting layer;

oxidizing at least a portion of said build up of said depositing material over said conducting layer down to the desired opening size to form an oxide layer of the said material; and removing said oxide layer by etching to expose said desired opening thereby completing formation of said self-aligned gated field emitter.

2. The method of claim 1 wherein said oxidizing of said build up of depositing material partially oxidizes the material and said removing said oxide layer leaves a layer of said build up of depositing material on said conducting layer which reduces the opening formed by said lithography and etching to said desired size.

3. The method of claim 1 wherein said vertical depositing material is taken from the group consisting of silicon or tantalum.

4. The method of claim 1 wherein said oxidation is done by thermal processing.

5. The method of claim 1 wherein said oxidation is done by anodic oxidation.

6. The method of claim 1 wherein said desired opening size is said opening formed by said lithography and etching.

7. The method of claim 6 wherein said oxidizing of said build up of depositing material completely oxidizes the material.

8. The method claim 1 wherein said depositing material is composed of two different materials which are successively deposited and which are silicon as the first layer and molybdenum as the second layer.

9. The method of claim 8 wherein the thickness of said first layer is between about 1 to 2 micrometers and the thickness of said second layer is between about 2000 to 4000 Angstroms.

10. The method of claim 1 wherein said substrate is composed of silicon, said first dielectric layer is composed of silicon oxide and said conducting layer is composed of molybdenum.

11. The method of claim 10 wherein said vertical depositing material is taken from the group consisting of silicon or tantalum.

12. The method of claim 10 wherein said depositing material is composed of two different materials which are successively deposited and which are silicon as the first layer and molybdenum as the second layer.

* * * * *